US008113137B2

(12) United States Patent
Thompson

(10) Patent No.: US 8,113,137 B2
(45) Date of Patent: Feb. 14, 2012

(54) FOLDING SEAT WITH MOVABLE BACKREST

(75) Inventor: Bruce F. Thompson, Rockledge, FL (US)

(73) Assignee: S2 Yachts Inc., Holland, MI (US)

( * ) Notice: Subject to any disclaimer, the term of this patent is extended or adjusted under 35 U.S.C. 154(b) by 245 days.

(21) Appl. No.: 12/512,365

(22) Filed: Jul. 30, 2009

(65) Prior Publication Data

US 2010/0031866 A1 Feb. 11, 2010

Related U.S. Application Data

(60) Provisional application No. 61/086,561, filed on Aug. 6, 2008.

(51) Int. Cl.
*B63B 17/00* (2006.01)

(52) U.S. Cl. ..... 114/363

(58) Field of Classification Search ..... 114/363, 114/364, 353, 354, 188, 194; 297/334, 316, 297/340, 353, 217.7
See application file for complete search history.

(56) References Cited

U.S. PATENT DOCUMENTS

| | | | | |
|---|---|---|---|---|
| 3,594,037 | A * | 7/1971 | Sherman | 297/14 |
| 5,497,724 | A * | 3/1996 | Brown et al. | 114/343 |
| 6,647,916 | B2 * | 11/2003 | Neese et al. | 114/363 |
| 6,726,279 | B1 * | 4/2004 | Figel et al. | 297/340 |

* cited by examiner

*Primary Examiner* — Lars A Olson
*Assistant Examiner* — Anthony Wiest
(74) *Attorney, Agent, or Firm* — Price Heneveld LLP

(57) ABSTRACT

A movable seat and backrest are coupled by a pivoted link system, allowing the seat to pivot from a raised stowed position to a lowered use position. A connecting link is coupled to one of the pivoted seat links, such that, as the seat is lowered, the connecting link raises the backrest. When the seat is raised to a stowed position, the connecting link lowers the backrest to a lowered position. When mounted in a vessel, the backrest forms part of the bolster system when the seat is stowed.

20 Claims, 7 Drawing Sheets

FOLDING SEAT WITH MOVABLE BACKREST

CROSS-REFERENCE TO RELATED APPLICATIONS

This application claims priority under 35 U.S.C. §119(e) and the benefit of U.S. Provisional Application No. 61/086,561 entitled Folding Seat With Movable Backrest, filed on Aug. 6, 2008, by Bruce F. Thompson, the entire disclosure of which is incorporated herein by reference.

BACKGROUND OF THE INVENTION

The present invention relates to a fold-out seat which includes a movable backrest which moves between a lowered stowed position, when the seat is stowed, and a raised use position, when the seat is folded out to a use position.

Many pleasure boats, such as those available in the Pursuit® and Tiara® lines of yachts, include seats across the transom for increasing the seating in the cockpit areas. Such seats are usually stowed in a vertical position parallel to the transom to allow full use of the cockpit. When additional seating is desired, they fold down from the vertical stowed position to a lowered position in which they form a bench seat. The bolster, which extends across the transom and along the port and starboard sides, typically forms the backrest for the seat. The bolster height in some vessels, however, is inconveniently low to form a comfortable backrest. Also, in some fold-out seat designs for vessels, the bolster is pivotally mounted to hold the seat in a stowed position and must be manipulated by pivoting the bolster upwardly to allow the folding seat to be extended. Subsequently, the bolster is again returned to its normal position. This complicates the operation of the seat for the user and the bolster may be uncomfortable for use as a backrest.

SUMMARY OF THE INVENTION

The present invention addresses the issue of providing a fold-out seat which can be easily moved between a stowed and use position. A bolster is coupled to the fold-out seat mechanism to move from a lowered position aligned with adjoining bolster sections of a vessel to a raised position forming a comfortable backrest when the seat is extended to a use position. Such construction eliminates the need for the operator to manipulate a bolster first to pull down a seat and then subsequently return the bolster to its original position and provides a one-motion operation to lower the seat and raise the bolster to a backrest position. Upon returning the seat to the stowed position, the bolster again returns to the aligned position with the remaining bolster sections.

Seats provided by the present invention provide such control of the seat and backrest by providing a parallel link connection for the seat allowing the seat to pivot from a raised stowed position to a lowered use position. A sliding backrest is coupled by a connecting link to one of the pivoted seat links, such that, as the seat is lowered, the connecting link raises the backrest to a more comfortable position. When the seat is again stowed, the connecting link lowers to move the backrest to a lowered position. When installed in a vessel, the backrest forms part of the bolster system in the cockpit of the vessel.

In one embodiment of the invention, magnetic catches are employed to secure the seat to the frame mechanism for the seat assembly in a stowed position. Although the seat and bolster/backrest assembly of the present invention typically are mounted to the transom of a vessel, such mechanisms can be employed in other areas and in other environments to provide compactly stowed seat and comfortable backrest when the seat is moved to a use position.

These and other features, objects and advantages of the present invention will become apparent upon reading the following description thereof together with reference to the accompanying drawings.

DETAILED DESCRIPTION OF THE PREFERRED EMBODIMENT

Figure 1:
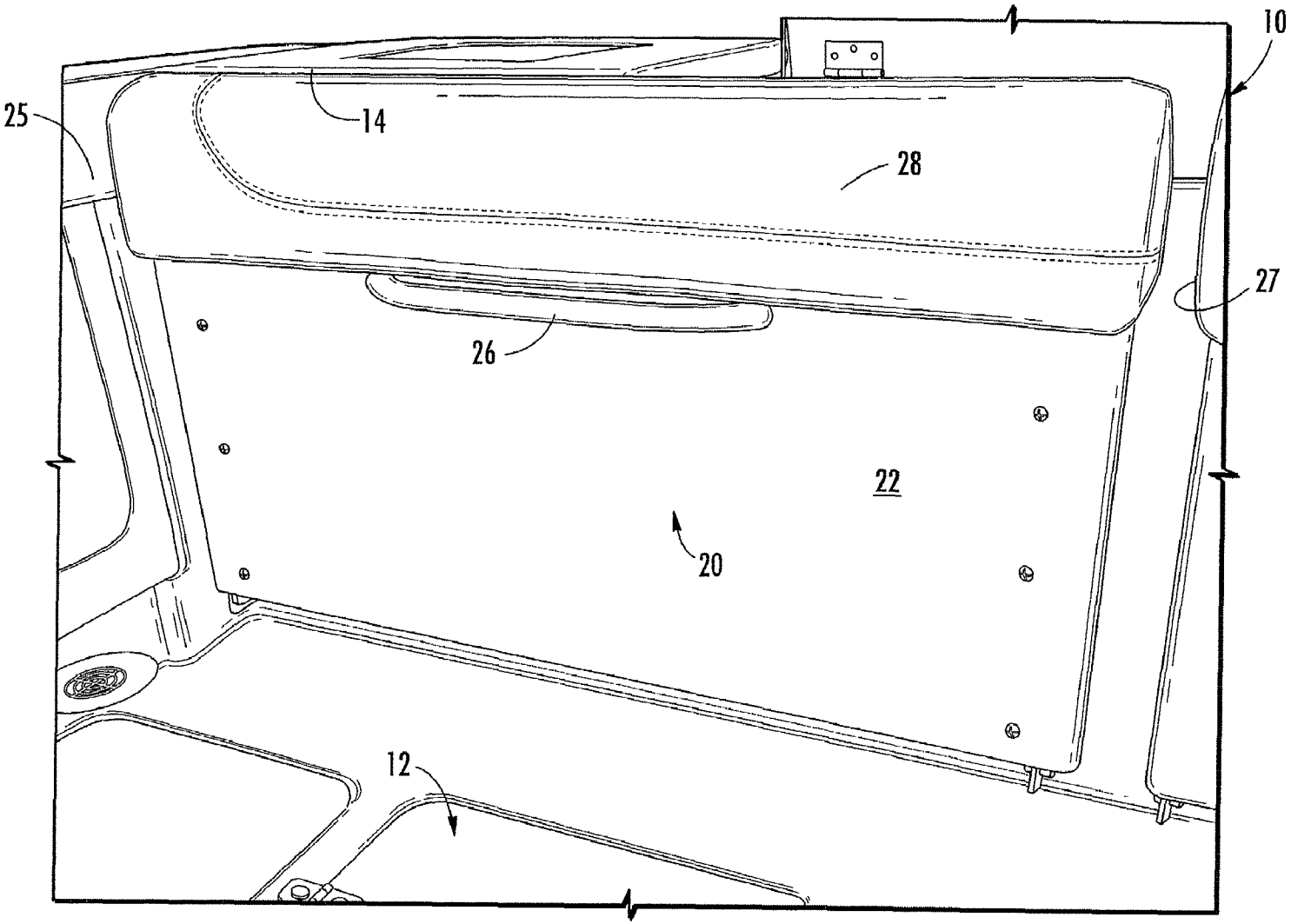
FIG. 1 is a perspective view of the transom of a vessel showing the seat and bolster/backrest in a stowed position.
Figure 2:
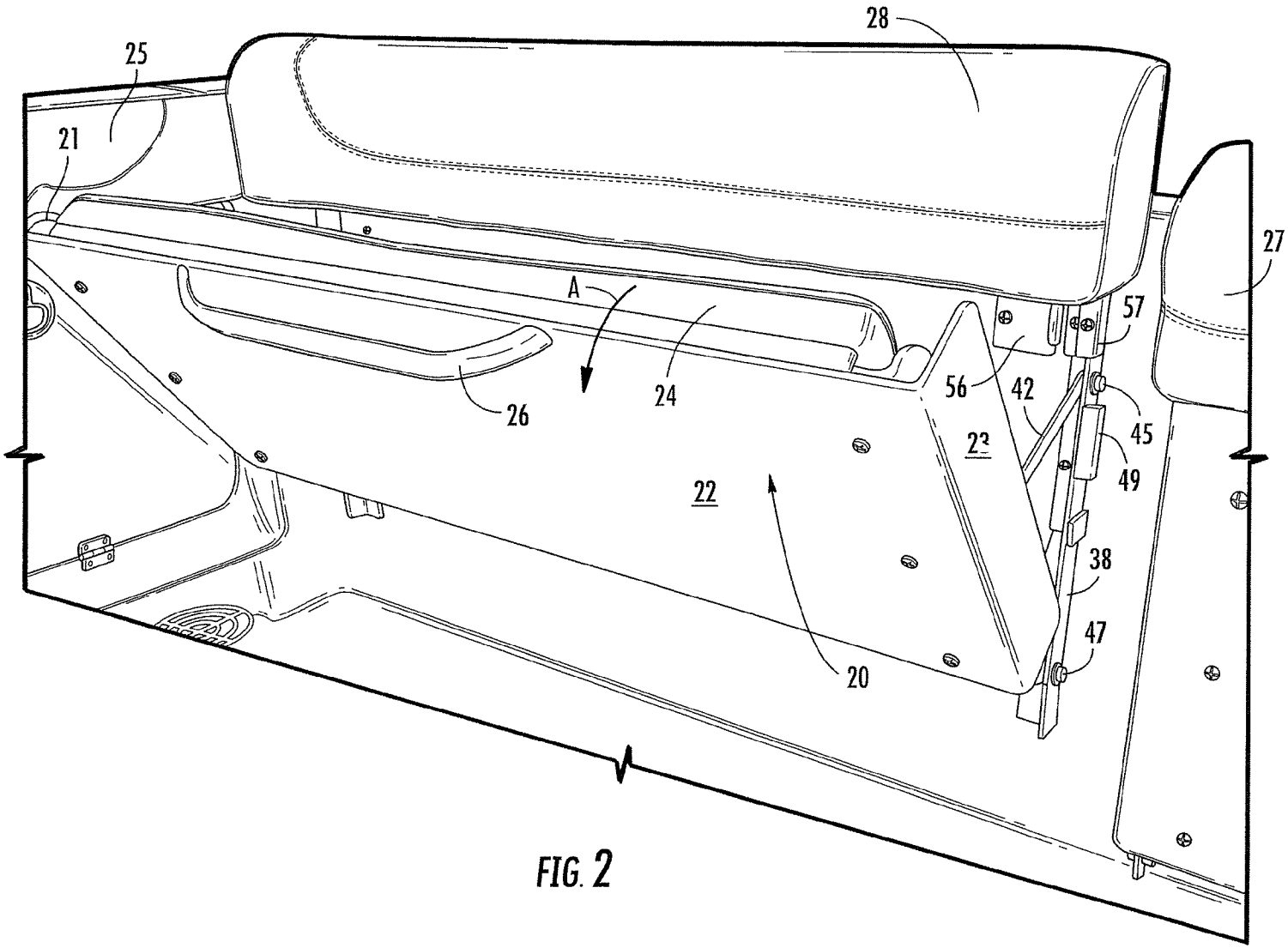
FIG. 2 is a perspective view of the structure shown in FIG. 1, showing the seat partially moved from the stowed position.
Figure 3:
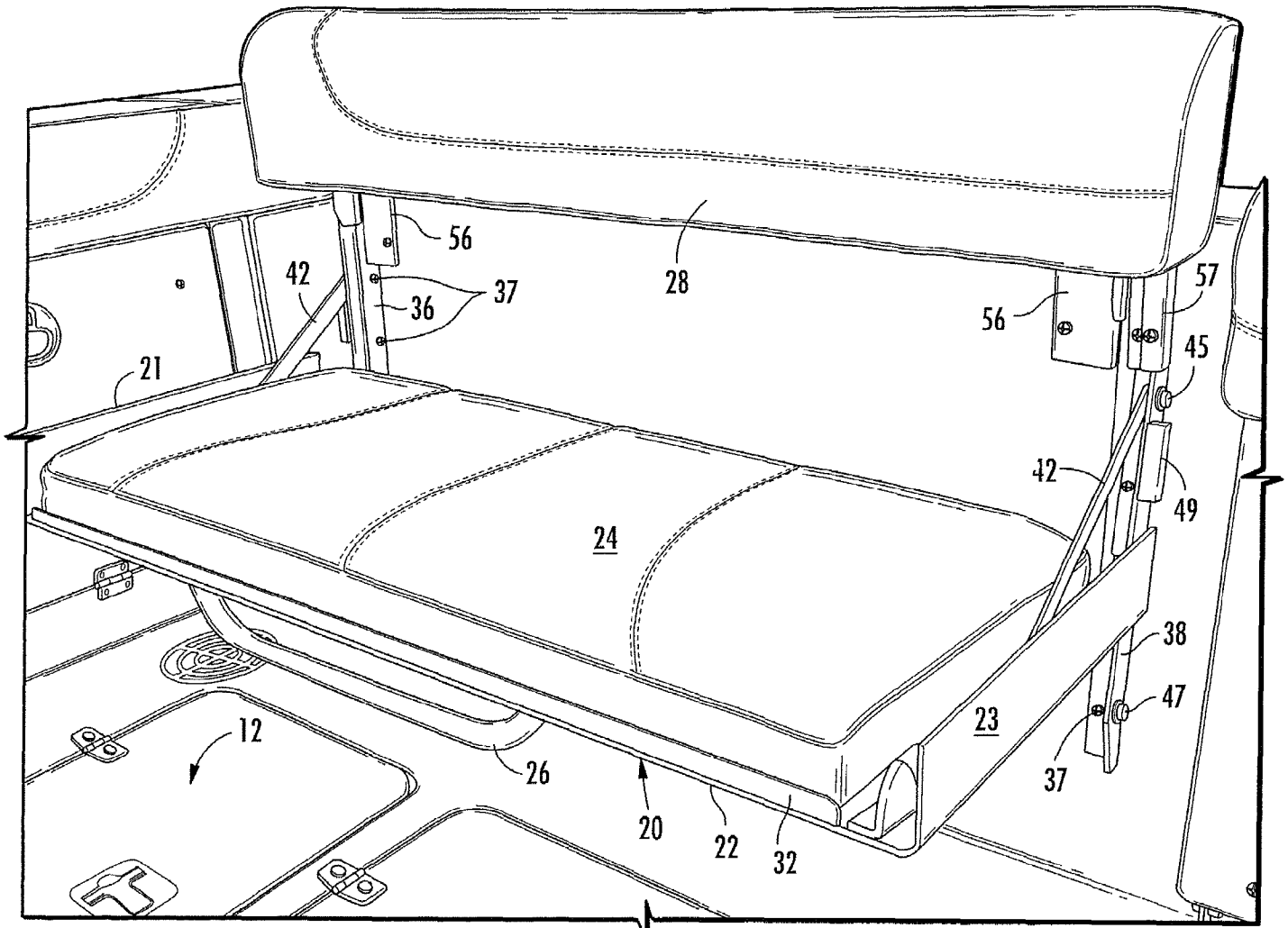
FIG. 3 is a perspective view of the seat and bolster/backrest, showing the seat in its lowered use position with the bolster raised to a backrest position.

Referring initially to FIGS. 1-3, there is shown a vessel 10, such as a 2008 Pursuit® 375 Offshore, which includes a cockpit area 12 at the stern of the vessel and having a transom 14 which includes one or more seat assemblies 20 of the present invention. The seat assembly includes a finished outer forward facing panel 22 which is generally U-shaped with sides 21 and 23, as best seen in FIG. 2. Panel 22 covers the seat frame and link assembly 40 (FIG. 4) for controlling the motion of the seat and its backrest. The seat assembly 20 includes a padded horizontally extending cushioned seat 24 (FIGS. 2 and 3) mounted to the frame assembly 40, as described below. A handle 26 is employed for moving the seat from a stowed position (FIG. 1) downwardly in a direction indicated by arrow A in FIG. 2 to the use position shown in FIG. 3. Seat assembly 20 also includes a vertically sliding seat back/bolster 28 which integrally forms part of the bolster system aligned with adjacent bolster sections 25 and 27 of the vessel when the seat is stowed, as shown in FIG. 1. When seat 24 is lowered for use, the backrest raises to a comfortable back supporting position, as seen in FIG. 3.

Figure 5:
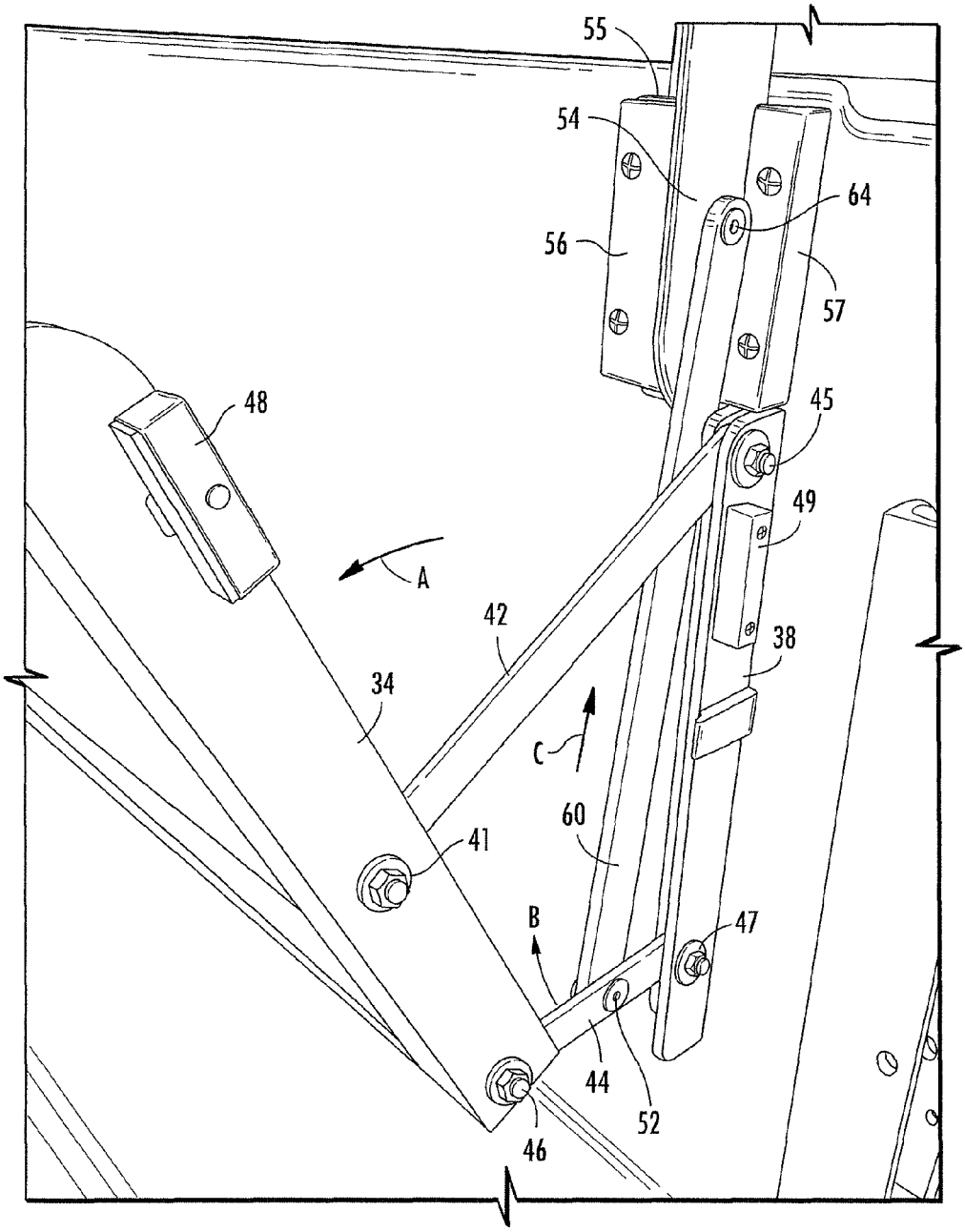
FIG. 5 is a perspective view of one end of the seat frame and link assembly shown in a partially extended position corresponding to FIG. 2.
Figure 6:
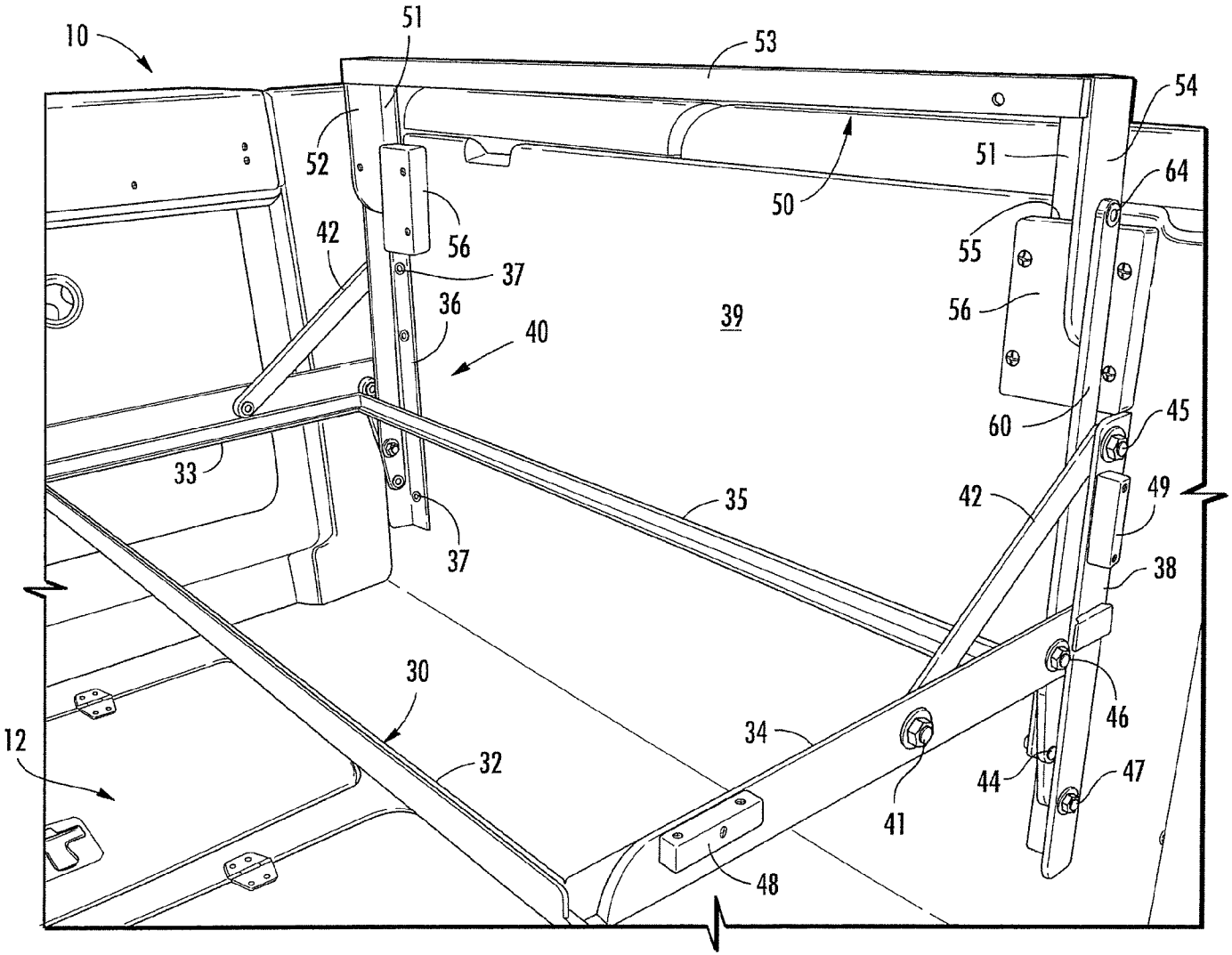
FIG. 6 is a perspective view of the seat frame and link assembly, illustrating the assembly when in a use position, as seen in FIG. 3.
Figure 7:
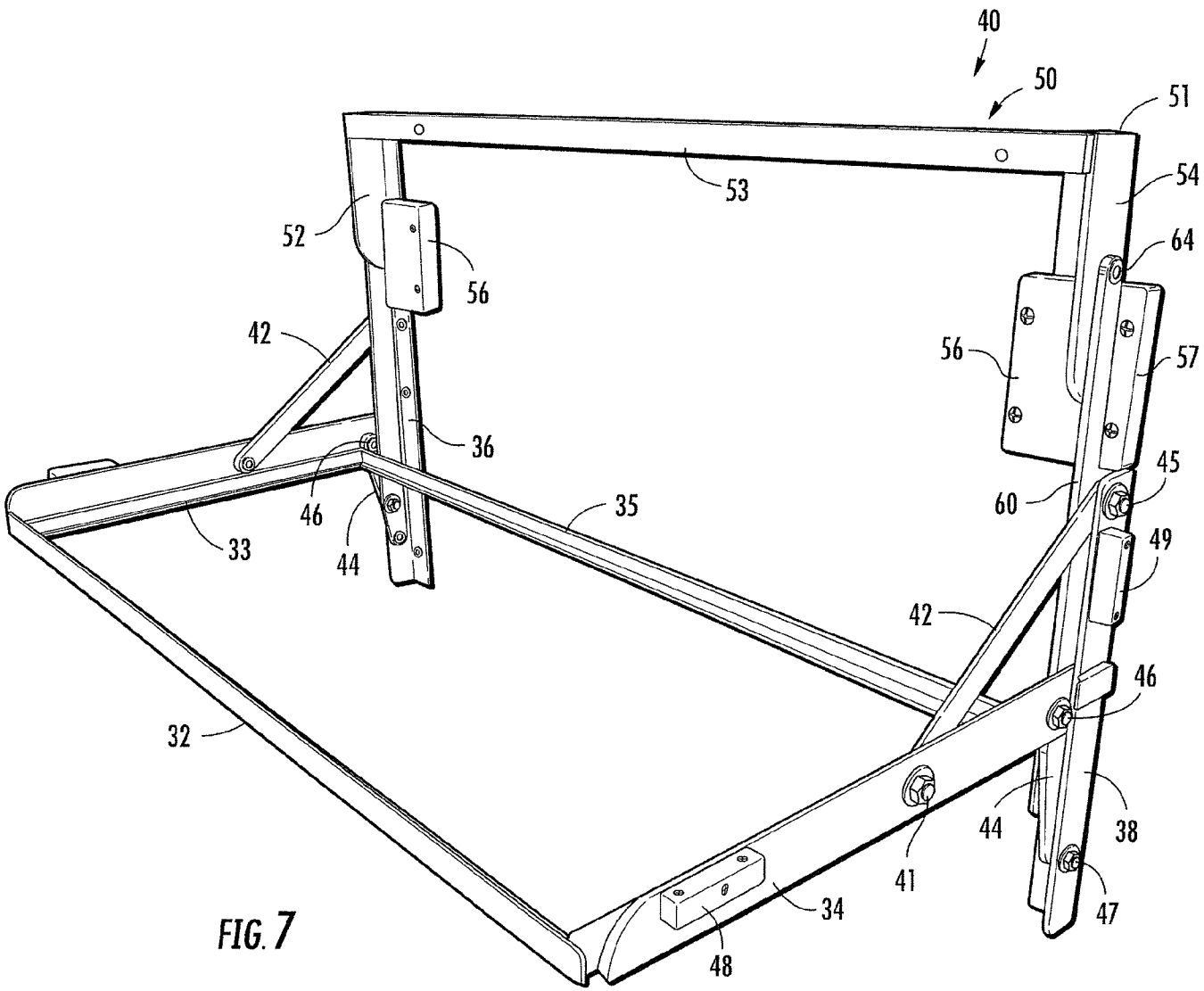
FIG. 7 is a drawing sheet showing the drawings for the individual components of the seat frame and link assembly shown in FIGS. 4-6.

As best seen in FIGS. 6 and 7, the frame assembly 40 for the seat comprises a generally rectangular seat frame 30 having a front leg 32, side legs 33 and 34, and a rear leg 35. The rearwardly extending legs 33, 34 are pivotally mounted at 46 (FIG. 5) to one end of link 44 having its opposite end pivotally mounted at 47 to vertically extending mounting brackets 36 (starboard) and 38 (port). Brackets 36, 38 are secured in spaced relationship to the stern transom bulkhead 39 by suitable fasteners 37. The pivot mounting of frame 30 to brackets 36 and 38 is through an upper link 42 (best seen in FIGS. 5 and 6) and a lower link 44. The linkage connection is symmetrical so that only the one link mechanism on one side of the seat (port side of the vessel) is described in detail. Link 42 is pivotally coupled to leg 34 by pivot connection 41 and to right angle bracket 38 by pivot connection 45. Lower link 44 is pivotally coupled to the end of leg 34 at pivot connection 46 and to bracket 38 at pivot connection 47.

Figure 4:
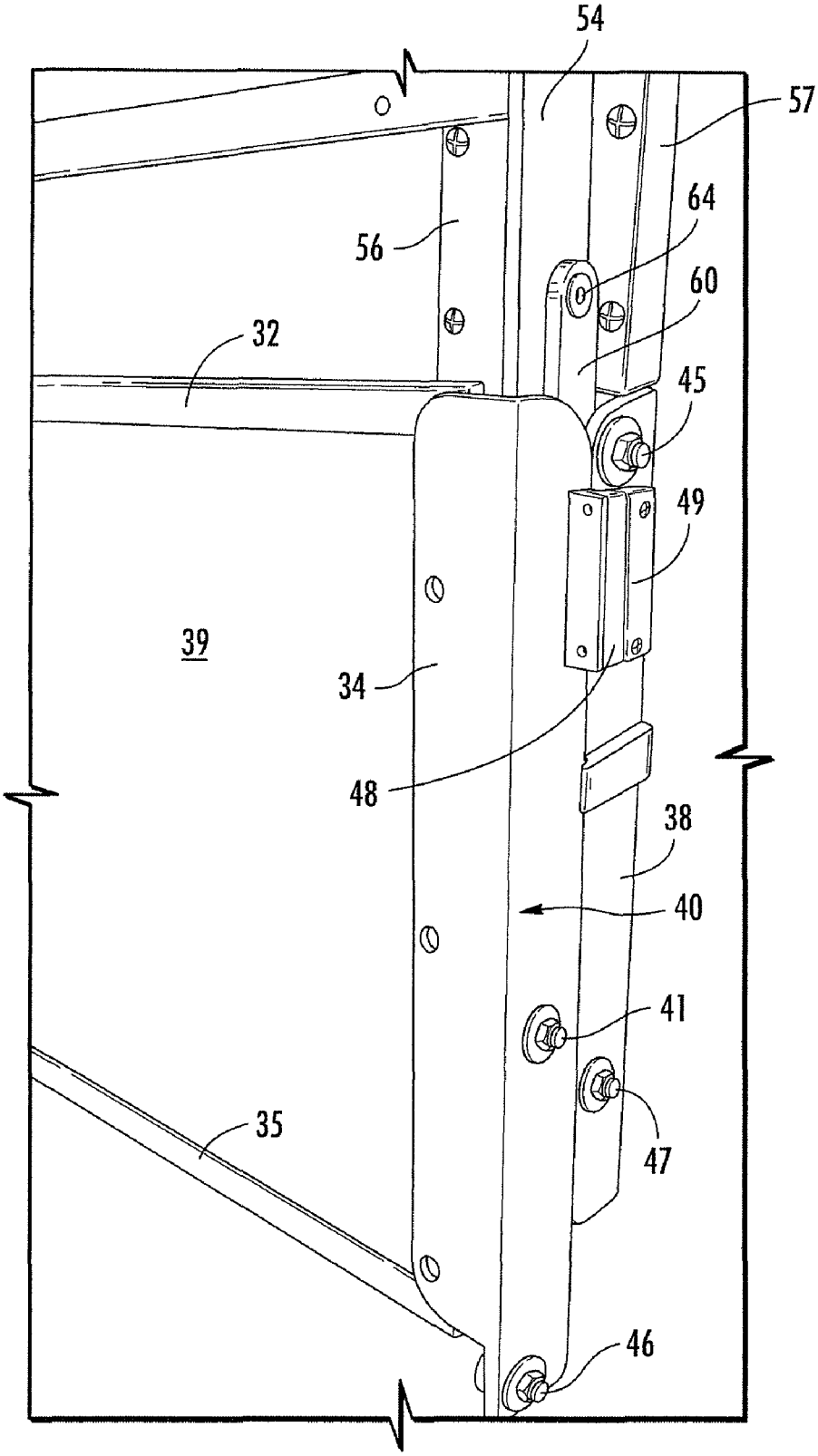
FIG. 4 is a perspective view of one end of the seat frame and link assembly for the seat shown in FIGS. 1-3, shown with the seat, trim and bolster removed, and shown in the seat stowed position corresponding to that of FIG. 1.

The seat back/bolster 28 is coupled to a generally inverted U-shaped frame 50 (FIGS. 6 and 7) having a top horizontally extending leg 53 and a pair of downwardly extending L-shaped legs 52 and 54 at opposite ends. Legs 52, 54 are slideably mounted in a slot in a lubricious polymeric bracket 56. Legs 52, 54 each have a flange 51 which fits within a slot 55 (FIG. 6) in brackets 56 (between surface 39 and the rear surface of brackets 56) to captively hold the movable frame 50 and also allow the seat back/bolster 28 to move upwardly and downwardly. To coordinate the motion of seat back frame 50 with the motion of seat frame 30, a connecting link 60 is pivotally coupled to link 44 at pivot connection 62 (FIG. 6) between the ends of link 44 and at its upper end to leg 54 of frame 50 at pivot connection 64. Leg 34 of the seat frame 30 includes a magnetic catch 48 which aligns with a magnetic catch 49 on bracket 38 when the seat is in a closed position, as seen in FIG. 4, to hold the seat in a vertical stowed position.

The operation of the seat is best understood by reference to FIG. 5 in which, when the seat frame 30 is rotated downwardly in the direction indicated by arrow A in FIG. 5, link 44 rotates from a generally vertical lower position parallel to bulkhead 39 upwardly, as indicated by arrow B in FIG. 5, which also raises connecting link 60 in a direction indicated by arrow C. Thus, as seat frame 30 is further pivoted to the position shown in FIG. 6, link 44 moves to a position parallel to bracket 38 as does link 60, thereby raising the seat back/bolster 28 attached to frame 50 from the lowered position, shown in FIG. 1, to a raised position, shown in FIG. 3. The movement of the bolster is through guide bracket 56 with leg 54 being L-shaped with a flange 51 (FIG. 6) which slides in slot 55 and is controlled by the guide bracket 56 on one side and a spaced-apart lubricious polymeric guide 57 on the opposite side of leg 54 to control the position of the seat back/bolster 28 in its movement between the lowered position, shown in FIG. 1, to the raised position, shown in FIG. 3. When the seat 24 is again stowed, the connecting links move in the opposite directions.

Thus, the seat assembly of the present invention provides a unique, movable backrest which serves as a bolster in the cockpit of a vessel and allows the compact storage of the seat with ease of control by rotating the seat downwardly utilizing only handle 26 from the stowed position, shown in FIG. 1, to the use position, shown in FIG. 3, where the seat back/bolster 28 becomes a comfortable backrest for the user. Although the seat assembly 20 of the present invention is shown mounted in the stern area of the cockpit of a vessel, it could be mounted in the port or starboard side of the cockpit area or used in other environments where compact storage of a fold-down seat with a movable backrest is desired.

It will become apparent to those skilled in the art that various modifications to the preferred embodiment of the invention as described herein can be made without departing from the spirit or scope of the invention as defined by the appended claims.

The invention claimed is:

1. A fold-down seat and bracket assembly comprising:

a frame assembly for attaching to a generally vertical wall, said frame assembly including a seat frame, a backrest frame, and mounting brackets;

a pair of links pivotally mounting said seat frame to said mounting brackets;

a guide for slideably mounting said backrest frame to a generally vertical wall for movement of said frame only parallel to the wall; and a connecting link pivotally coupled to one of said pair of links coupling said seat frame to said mounting brackets and pivotally coupled to said backrest frame, such that, as said seat frame is pivoted downwardly, said connecting link moves upwardly to raise said backrest frame only in a vertical direction.

2. The assembly as defined in claim 1 and further including a padded seat mounted to said seat frame.

3. The assembly as defined in claim 2 and further including a padded backrest mounted to said backrest frame.

4. The assembly as defined in claim 1 wherein said guide is a polymeric guide associated with said backrest frame for controlling the motion of said backrest frame.

5. The assembly as defined in claim 4 and further including a latch between said seat frame and said brackets for releasably holding said seat frame in a stowed position adjacent said brackets.

6. The assembly as defined in claim 5 wherein said latch comprises a magnetic catch.

7. A fold-down seat assembly for a vessel comprising:

a frame assembly for attaching to a generally vertical wall of a vessel, said frame including a seat section, a backrest section, and a pair of spaced-apart mounting brackets;

a pair of links pivotally mounting said seat section to said mounting brackets;

a slideable mount for slideably mounting said backrest section to the vertical wall of said vessel for movement only in a vertical direction; and a connecting link pivotally coupled to at least one of said pair of links coupling said seat section to said mounting brackets and pivotally coupled to said backrest section, such that, as said seat section is pivoted from a stowed generally vertical position to a generally horizontal use position, said connecting link moves to vertically raise said backrest section.

8. The seat assembly as defined in claim 7 wherein said seat section includes a padded seat.

9. The seat assembly as defined in claim 7 wherein said backrest section includes a padded backrest.

10. The seat assembly as defined in claim 7 and further including a guide for controlling the motion of said backrest section.

11. The seat assembly as defined in claim 7 and further including a latch for holding said seat section in a stowed position adjacent said mounting brackets.

12. The seat assembly as defined in claim 7 wherein said connecting link moves upwardly to raise said backrest section.

13. The seat assembly as defined in claim 7 and further including bolsters on said vessel and wherein said backrest aligns vertically with said bolsters when in a lowered position with said seat in a stowed position.

14. A vessel including:

a stern cockpit having a transom, sides and bolsters mounted to said transom and sides;

a frame assembly for attaching to said transom, said frame including a seat section, a backrest section, and mounting brackets;

a pair of links pivotally mounting said seat section to said mounting brackets and wherein said backrest section is slideably mounted to said transom; and a connecting link is pivotally coupled to at least one of said pair of links coupling said seat section to said mounting brackets and pivotally coupled to said backrest section, such that, as said seat section is pivoted from a raised stowed position to a lowered use position, said connecting link moves said backrest section upwardly from a position aligned with adjacent bolsters to a position vertically offset from adjacent bolsters.

15. The vessel as defined in claim 14 wherein said seat section includes a padded seat.

16. The vessel as defined in claim 15 wherein said backrest section includes a padded backrest.

17. The vessel as defined in claim 14 and further including a guide for controlling the motion of said backrest section.

18. The vessel as defined in claim 14 and further including a latch for holding said seat section in a stowed position adjacent said mounting brackets.

19. The vessel as defined in claim 18 wherein said latch is a magnetic catch.

20. The vessel as defined in claim 14 wherein said connecting link moves upwardly to raise said backrest section.

* * * * *